US010720120B2

(12) United States Patent
Yang

(10) Patent No.: US 10,720,120 B2
(45) Date of Patent: Jul. 21, 2020

(54) SOURCE DRIVER AND DISPLAY DEVICE INCLUDING THE SAME

(71) Applicant: DB HiTek Co., Ltd, Seoul (KR)

(72) Inventor: Seung Chul Yang, Seoul (KR)

(73) Assignee: DB HiTek Co., Ltd., Seoul (KR)

( * ) Notice: Subject to any disclaimer, the term of this patent is extended or adjusted under 35 U.S.C. 154(b) by 0 days.

(21) Appl. No.: 16/201,046

(22) Filed: Nov. 27, 2018

(65) Prior Publication Data

US 2019/0189076 A1 Jun. 20, 2019

(30) Foreign Application Priority Data

Dec. 14, 2017 (KR) ..... 10-2017-0172482

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 2310/027* (2013.01); *G09G 2310/0286* (2013.01); *G09G 2310/0291* (2013.01); *G09G 2310/0297* (2013.01); *G09G 2310/06* (2013.01); *G09G 2310/08* (2013.01)

(58) Field of Classification Search
CPC ..... G09G 2310/0291; G09G 2310/027; G09G 3/3696; G09G 3/3685; G09G 2320/0223; G09G 2300/0426; G09G 3/36; G09G 5/006; G09G 2310/0275; G09G 2310/0286; G09G 2370/08; G09G 2310/0218; G09G 2340/0464; G09G 3/3611; G09G 3/3648; G09G 3/3655; G09G 2310/0297; G09G 2310/08; G09G 3/2092; G09G 2320/0233; G09G 2310/0294; G09G 2330/06; G09G 3/3275
USPC ..... 345/98–100
See application file for complete search history.

(56) References Cited

U.S. PATENT DOCUMENTS 7,592,993 B2 * 9/2009 Kim ..... G09G 3/3688 345/98
9,875,714 B2 * 1/2018 Lee ..... G09G 3/3688
2009/0058788 A1 * 3/2009 Ha ..... G09G 3/3611 345/99
2011/0037758 A1 * 2/2011 Lim ..... H03L 7/0805 345/213

(Continued)

*Primary Examiner* — Duc Q Dinh
(74) *Attorney, Agent, or Firm* — Andrew D. Fortney; Central California IP Group, P.C.

(57) ABSTRACT

A source driver and a display device including the same includes a latch unit to store data, a digital-to-analog conversion (DAC) unit to convert the stored data into an analog signal, amplifiers to amplify or buffer the analog signal, output pads, output switches between the DAC unit and the output pads corresponding to the amplifiers, and an output controller to generate switch control signals that control the output switches based on/in response to a source output enable signal. The amplifiers and the output switches include a plurality of groups. The switch control signals to the output switches of each group may have different delay times based on the source output enable signal. Delay times between contiguous switch control signals to at least one group may be different from delay times between contiguous switch control signals to one or more other groups.

18 Claims, 6 Drawing Sheets

(56) References Cited

U.S. PATENT DOCUMENTS

2015/0364099 A1* 12/2015 Shibuya ..... H03K 5/15
345/204

* cited by examiner

SOURCE DRIVER AND DISPLAY DEVICE INCLUDING THE SAME

This application claims the benefit of Korean Patent Application No. 10-2017-0172482, filed on Dec. 14, 2017, which is hereby incorporated by reference as if fully set forth herein.

BACKGROUND OF THE INVENTION

Field of the Invention

Embodiments of the present invention relate to a source driver and a display device including the same.

Discussion of the Related Art

In general, a display device, for example, a liquid crystal display (LCD), displays an image by adjusting light transmittance of liquid crystal cells using optical properties of liquid crystal in which molecular arrangement is changed by an electric field, and includes a display panel and a source driver for supplying data to the display panel.

Generally, in order to control a timing point where image information is output to a display panel, the source driver uses a latch signal associated with a timing point at which latches of channels receive data from a timing controller.

SUMMARY OF THE INVENTION

Accordingly, embodiments of the present disclosure are directed to a source driver and a display device including the same that substantially obviate one or more problems due to limitations and disadvantages of the related art.

An object of certain embodiments is to provide a source driver capable of controlling an output time point of each group (e.g., of amplifiers) including a plurality of channels. Embodiments of the present invention also include a display device including the source driver.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure(s) particularly pointed out in the written description and claims hereof, as well as the appended drawings.

To achieve these objects and other advantages and in accordance with the purpose(s) of the invention, as embodied and broadly described herein, the source driver includes (a) a latch unit configured to store data, (b) a digital-to-analog conversion (DAC) unit configured to convert the data stored in the latch unit to analog signals (e.g., through digital-to-analog conversion), (c) a plurality of amplifiers configured to amplify or buffer the analog signals, and output the amplified or buffered signals, (d) a plurality of output pads, (e) a plurality of output switches between the digital-to-analog conversion (DAC) unit and the plurality of output pads, respectively corresponding to the plurality of amplifiers, and (f) an output controller configured to generate a plurality of switch control signals that control the plurality of output switches based on or in response to a source output enable signal. The plurality of amplifiers and the plurality of output switches comprise a plurality of groups. The switch control signals supplied to the output switches in each of the groups have different delay times based on or in response to the source output enable signal.

A difference in the delay time between two contiguous switch control signals supplied to at least one of the groups is different from a difference in the delay time between two contiguous switch control signals supplied to each of the other groups.

The difference in the delay time between the two contiguous switch control signals supplied to one of the groups may be identical to the difference in the delay time between two contiguous switch control signals supplied to another one of the groups.

Each of the output switches may be between an input terminal of a corresponding amplifier and a corresponding output terminal of the digital-to-analog conversion (DAC) unit, in which case the digital-to-analog conversion unit is configured to output the analog signals.

Alternatively, each of the output switches may also be between an output terminal of a corresponding amplifier and a corresponding output pad.

The source output enable signal may control output signals from the amplifiers through the output pads.

The source driver may further include a clock recovery unit configured to (i) receive an input signal, the input signal comprising a clock signal and data, (ii) recover the clock signal from the received input signal, (iii) generate a plurality of delayed clock signals having different delay times in response to the recovered clock signal, and (iv) generate an internal clock signal in response to the plurality of delayed clock signals, and/or a logic controller configured to (a) recover image-associated data from the input signal in response the internal clock signal, and (b) supply the recovered image-associated data to the latch unit.

The logic controller may generate the source output enable signal in response to the input signal and the internal clock signal.

The output controller may include (1) a channel signal generator unit configured to (i) receive the plurality of clock signals from the clock recovery unit, (ii) receive the source output enable signal and a selection signal from the logic controller, (iii) generate channel clock signals by dividing and delaying the plurality of clock signals (e.g., based on or in response to the selection signal), and (iv) generate a channel signal by delaying the source output enable signal (e.g., based on or in response to the selection signal), and (2) a channel clock signal controller configured to receive the plurality of channel clock signals and the channel signal from the channel signal generator unit, and generate the switch control signals using the received channel clock signals and the received channel signal.

According to one or more other embodiments, the source driver includes a plurality of output pads, a plurality of drivers configured to supply drive signals to the plurality of output pads, and an output controller configured to generate switch control signals based on or in response to a source output enable signal. Each of the plurality of drivers may include a latch unit configured to store data, a digital-to-analog conversion (DAC) unit configured to convert the data stored in the latch unit to analog signals (e.g., through digital-to-analog conversion), an output unit having a plurality of amplifiers configured to amplify or buffer the analog signals and output the amplified or buffered analog signals, and an output switch between the digital-to-analog conversion (DAC) unit and a corresponding output pad, controlled by a corresponding switch control signal. The plurality of drivers may comprise a plurality of groups, and each of the groups may include at least two drivers. Switch control signals supplied to output switches of the drivers in each of the groups may have different delay times based on or in response to the source output enable signal. A difference in the delay time between two contiguous switch control signals supplied to at least one of the groups may be different from the difference in the delay time between two contiguous switch control signals supplied to each of the other groups. The source output enable signal may control output signals of the amplifiers (e.g., to be output through the output pads).

The difference in the delay time between the two contiguous switch control signals supplied to one of the groups may be identical to the difference in the delay time between two contiguous switch control signals supplied to another one of the groups.

Each of the output switches in each of the groups may be between an input terminal of a corresponding amplifier in each of the groups and a corresponding output terminal of the digital-to-analog conversion (DAC) unit, in which case the DAC unit is configured to output the analog signals.

Each of the output switches in each of the groups may be between an output terminal of a corresponding amplifier in each of the groups and a corresponding output pad.

The source driver may further include a clock recovery unit configured to receive an input signal comprising a clock signal and data, recover clock signal from the received input signal, generate a plurality of delayed clock signals having different delay times in response to the recovered clock signal, and generate an internal clock signal in response to the plurality of delayed clock signals, and a logic controller configured to recover image-associated data from the input signal in response to the internal clock signal, and supply the recovered image-associated data to the latch unit.

The logic controller may generate the source output enable signal using the input signal and the internal clock signal.

The output controller may include a plurality of channel signal generators corresponding to the plurality of groups, and a plurality of channel clock signal controllers corresponding to the plurality of channel signal generators. Each of the channel signal generators is configured to receive (i) the plurality of delayed clock signals from the clock recovery unit and (ii) the source output enable signal and a corresponding selection signal from the logic controller. Each of the channel signal generators may generate (i) channel clock signals by dividing and delaying the plurality of clock signals based on or in response to a corresponding selection signal and (ii) a channel signal by delaying the source output enable signal based on or in response to a corresponding selection signal. Each of the channel clock signal controllers is configured to generate switch control signals configured to control output switches in a corresponding group using the channel clock signals and a channel signal received from a corresponding channel signal generator.

A difference in the delay time between two contiguous channel clock signals among the channel clock signals generated from the channel signal generator in each of the groups may be identical to a difference in delay time between other two other ones of the channel clock signals.

The channel signals generated from the plurality of channel signal generators may have different delay times based on or in response to the source output enable signal.

The difference in the delay time between the two contiguous channel clock signals generated from the channel signal generator in one of the groups may be different from the difference in the delay time between two contiguous clock signals generated from the channel signal generator in another one of the groups.

Each of the channel clock signal controllers includes one or more shift registers corresponding to the channel clock signals. Each of the shift registers receives the channel signal, and generates switch control signals configured to control output switches in a corresponding group by synchronizing with a corresponding channel clock signal.

According to one or more other embodiments, the display device includes a display panel including gate lines, data lines, and pixels connected to the gate and data lines. The pixels are in a matrix having rows and columns. The display device also includes a data driver configured to drive the data lines, and a gate driver configured to drive the gate lines. The data driver is or comprises the source driver according to one or more embodiments of the present invention.

It is to be understood that both the foregoing general description and the following detailed description of various embodiments of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
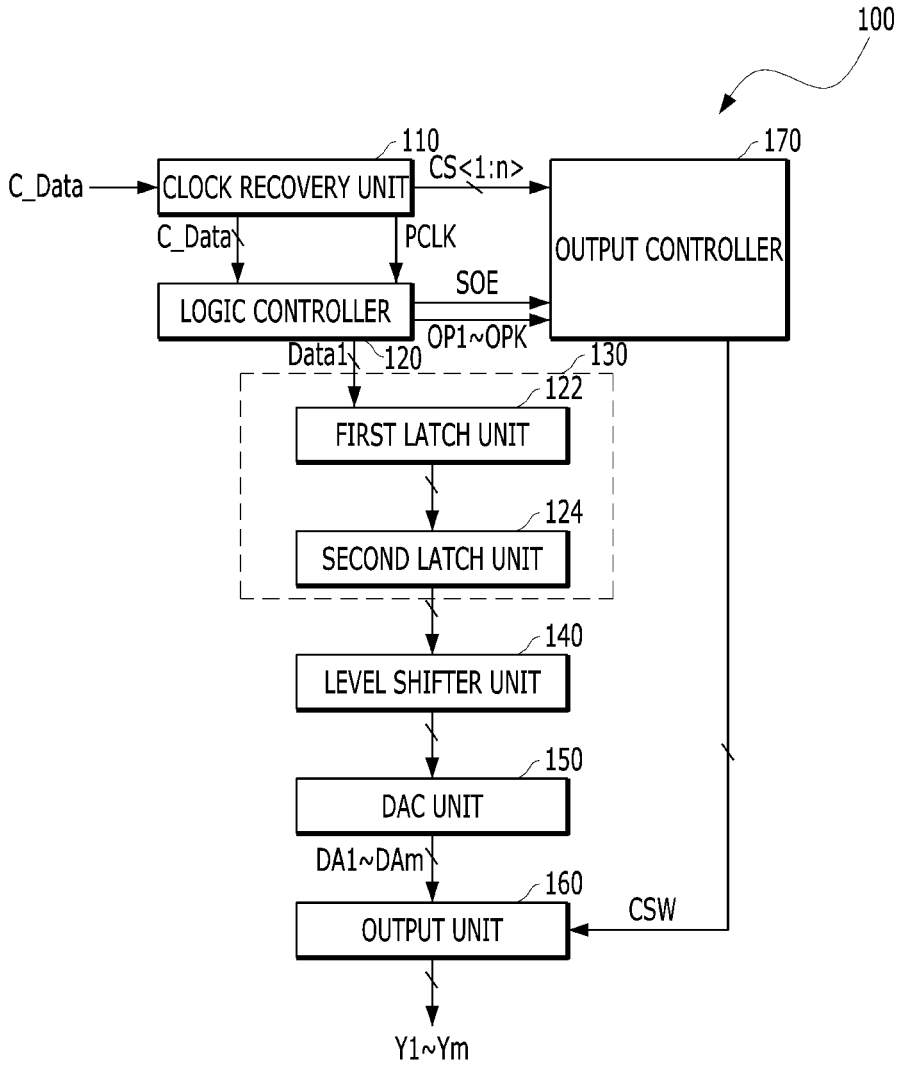
FIG. 1 is a block diagram illustrating an exemplary source driver according to one or more embodiments of the invention.

Reference will now be made in detail to embodiments of the present disclosure, examples of which are illustrated in the accompanying drawings.

In the following description of various embodiments, it will be understood that, when an element is referred to as being "on" or "under" another element, it can be directly on or under the other element or can be indirectly on or under the other element with one or more intervening elements therebetween. Furthermore, when the expression "on" or "under" is used herein, it may include the upward direction and the downward direction with reference to an element.

In addition, it will be understood that relative terms used hereinafter, such as "first", "second", "on"/"above"/"over" and "under"/"below"/"beneath" may be construed only to distinguish one element from another element without necessarily requiring or involving a certain physical or logical relation or sequence between the elements. In addition, the same reference numerals will be used throughout the drawings to refer to the same or like parts.

The terms "including", "comprising", "having" and variations thereof disclosed herein mean "including but not limited to" unless expressly specified otherwise, and, as such, should not be construed to exclude elements other than the elements disclosed herein and should be construed to further include additional elements. In addition, the terms "corresponding" and variations thereof disclosed herein may encompass at least one of the meanings of "facing," "overlapping" and "in a unique or 1:1 relationship with."

FIG. 1 is a block diagram illustrating an exemplary source driver 100 according to one or more embodiments of the present invention.

Referring to FIG. 1, the source driver 100 may include a clock recovery unit 110, a logic controller 120, a latch unit 130, a level shifter unit 140, a digital-to-analog converter (DAC) unit 150, an output unit 160, and an output controller 170.

Figure 9:
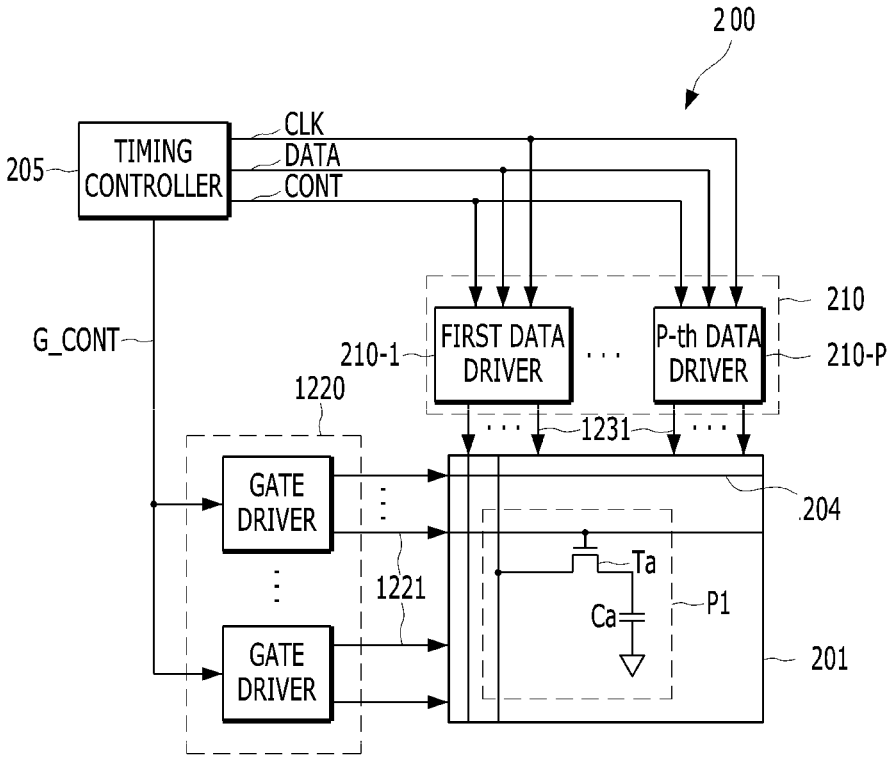
FIG. 9 illustrates an exemplary display device 200 according to one or more embodiments of the present invention.

The clock recovery unit 110 may receive an input signal C_Data, which includes clock signal and data, from a timing controller 205 (see FIG. 9). For example, the input signal C_Data transmitted from the timing controller 205 to the clock recovery unit 110 may include clock-embedded data. In addition, the input signal C_Data may further include, for example, a dummy signal.

The clock recovery unit 110 may recover a clock signal from the input signal C_Data, and may generate a recovered clock signal.

The clock recovery unit 110 may generate a plurality of clock signals CS<1:*n*>. Each of the clock signals CS<1:*n*> may have a different phase (e.g., a different delay time).

The clock recovery unit 110 may generate the plurality of clock signals CS<1:*n*> from the recovered clock signal.

For example, the clock recovery unit 110 may generate the plurality of clock signals CS<1:*n*>, each having a different delay time, by delaying the recovered clock signal by a plurality of different delay times, and outputting each of the differently delayed clock signals.

In addition, the plurality of clock signals CS<1:*n*> may have the same frequency and different delay times based on or relative to the recovered clock signal.

For example, the clock recovery unit 110 may comprise a delay locked loop (DLL) to configure generate the plurality of clock signals CS<1:*n*>.

The clock recovery unit 110 may generate an internal clock signal PCLK from one or more of the plurality of clock signals CS<1:*n*>.

For example, the clock recovery unit 110 may select one of the clock signals CS<1:*n*> and output the selected clock signal as the internal clock signal PCLK.

The logic controller 120 may receive the input signal C_Data and the internal clock signal PCLK from the clock recovery unit 110.

The logic controller 120 may (i) recover image-associated data Data1 from the input signal C_Data using the internal clock signal PCLK, (ii) convert the recovered data Data1 into parallel data, and (iii) transmit the parallel data to the latch circuit 130.

For example, the logic controller 120 may recover the data signal Data1 from the input signal C_Data by synchronizing the data signal Data 1 with the internal clock signal PCLK.

The logic controller 120 may generate a source output enable signal SOE from or using the input signal C_Data and the internal clock signal PCLK.

For example, the logic controller 120 may extract a start signal START (not shown), an end signal END (not shown), and a data enable signal DE (not shown) from the input signal C_Data, and may generate and output the source output enable signal SOE using (e.g., directly or indirectly from) the internal clock signal PCLK. The source output enable signal SOE may also be referred to as an "Enable Signal" or "CLK1" as necessary, and may control output signals of amplifiers 161-1 to 161-*m* as output through output pads P1 to Pm (see FIG. 2A).

For example, the logic controller 120 may process the start signal START, the end signal END, and the data enable signal DE by synchronizing the signals with the internal clock signal PCLK, and may generate the source output enable signal SOE, based on or in response to the above signals START, END, and DE.

The latch unit 130 may store parallel data Data1 received from the logic controller 120.

For example, the latch unit 130 may include a first latch unit 122 and a second latch unit 124. The first latch unit 122 may store parallel data Data1 received from the logic controller 120. In addition, the first latch unit 122 may include a plurality of first latches (not shown).

The second latch unit 124 may receive and store data from the first latch unit 122. In addition, the second latch unit 124 may include a plurality of second latches (not shown) corresponding to the plurality of first latches in the first latch unit 122.

The level shifter unit 140 may change a level (e.g., a voltage) of the data received from the second latch unit 124, and may output the data at a different level. For example, the level shifter unit 140 may convert the data from the second latch unit 124 having a first-level voltage into data having a second-level voltage (e.g., higher than the first-level voltage).

The level shifter unit 140 may include a plurality of level shifters (not shown) corresponding to the second latches of the second latch unit 124. Although the number of level shifters may be identical to the number of first latches and/or the number of second latches, the scope or spirit of the present disclosure is not limited thereto.

The DAC unit 150 may convert an output signal (e.g., digital data) from the level shifter unit 140 into an analog signal.

For example, the DAC unit 150 may select one grayscale voltage from a plurality (e.g., $2^n$, where n is an integer of 3 to 12 of grayscale voltages received from a power-supply unit (not shown) based on or in response to the output signal of the level shifter unit 140, and may output the selected grayscale voltage.

For example, the power-supply unit (not shown) may be implemented as a plurality of resistors connected in series between a supply voltage source VDD2 and a base voltage (e.g., a ground voltage GND), and may generate a plurality of grayscale voltages having a plurality of steps (e.g., $2^n$ steps, such as 256 steps when n=8).

The output unit 160 may amplify (or buffer) signals DA1 to DAm received from the DAC unit 150, and may output the amplified (or buffered) signals Y1 to Ym (where m is a natural number higher than 1).

The output unit 160 may include (i) a plurality of output pads connected to data lines of a display panel (see, e.g., FIG. 9), (ii) a plurality of output switches (see FIGS. 2A-B) between the DAC unit 150 and the output pads, configured to be controlled by switch control signals, and (iii) amplifiers configured to amplify or buffer the output signals DA1 to DAm from the DAC unit 150.

The plurality of amplifiers of the output unit 160 may correspond to channels or data lines of the display panel, and may supply a drive signal in which the analog signal (e.g. output form the amplifier) corresponds to a particular channel org data line.

To implement inversion-based driving and/or an inversion process, the source driver 100 may further include a multiplexer unit (not shown) between the DAC unit 150 and the output unit 160.

The multiplexer unit may select any one of the output signals DA1 to DAm from the DAC unit 150, and may supply the selected output signal to one amplifier among the plurality of amplifiers of the output unit 160.

The multiplexer unit may include a plurality of multiplexers (or a plurality of decoders).

For example, based on or in response to a polarity control signal POL (not shown), each of the multiplexers (or the respective decoders) may supply an output signal from one of the two multiplexers to one of two amplifiers corresponding to the selected multiplexer, and may supply an output signal from the other selected multiplexer to the other amplifier.

For example, although the two selected multiplexers may be two contiguous multiplexers from among the plurality of multiplexers, the scope or spirit of the present disclosure is not limited thereto.

Figure 2A:
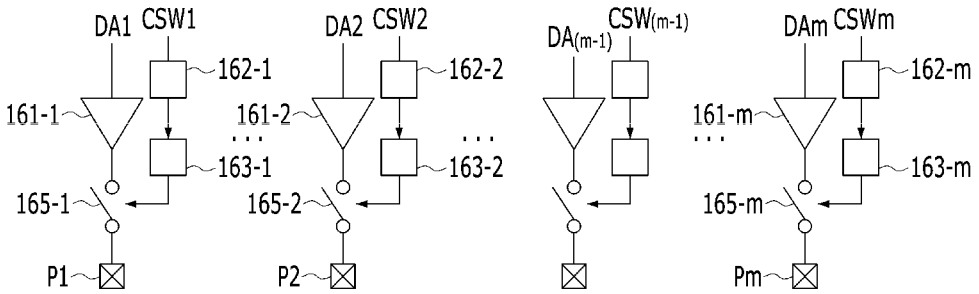
FIG. 2A is a circuit diagram illustrating an exemplary output unit suitable for the source driver of FIG. according to one or more embodiments of the present invention.

FIG. 2A is a circuit diagram illustrating the exemplary output unit 160 of FIG. 1, according to an embodiment of the present invention.

Referring to FIG. 2A, the output unit 160 may include a plurality of amplifiers 161-1 to 161-*m* (where m is a natural number greater than 1), and may include a plurality of output pads P1 to Pm and a plurality of output switches 165-1 to 165-*m*.

Each of the amplifiers 161-1 to 161-*m* may amplify or buffer a corresponding output signal DA1 to DAm from the DAC unit 150.

The plurality of output switches 165-1 to 165-*m* may respectively correspond to the plurality of amplifiers 161-1 to 161-*m*, and may be controlled by a corresponding switch control signal CSW1 to CSWm (where m is a natural number greater than 1).

Each of the output switches 165-1 to 165-*m* may transmit a corresponding output signal DA1 to DAm from the DAC unit 150 to a corresponding output pad P1 to Pm (where m is a natural number greater than 1).

Each of the output switches 165-1 to 165-*m* may be between an output terminal of a corresponding amplifier 161-1 to 161-*m* and a corresponding output pad P1 to Pm.

The output unit 160 may further include a plurality of level shifters 162-1 to 162-*m* and a plurality of buffers 163-1 to 163-*m*.

Each of the level shifters 162-1 to 162-*m* may perform level conversion on a corresponding switch control signal CSW1 to CSWm (where m is a natural number greater than 1), and may output a level-converted switch control signal. For example, each of the level shifters 162-1 to 162-*m* may increase a voltage level of the corresponding switch control signal.

Each of the buffers 163-1 to 163-*m* may buffer an output signal from a corresponding level shifter 162-1 to 162-*m*, and may output a buffered switch control signal.

Figure 2B:
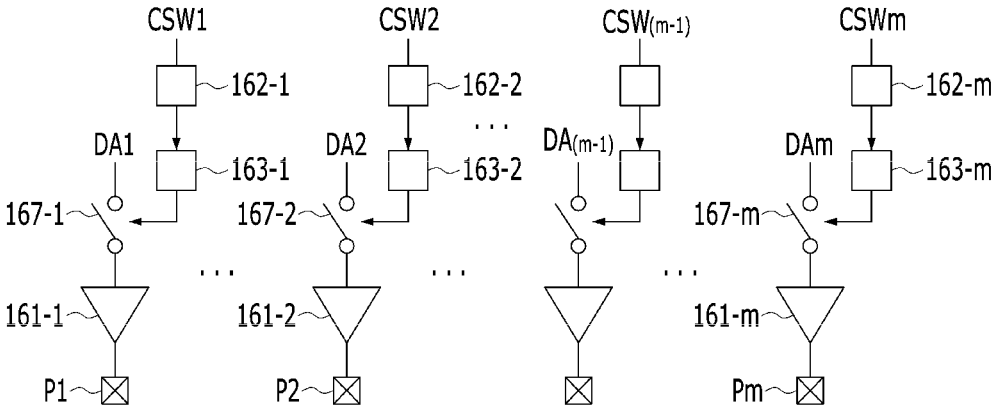
FIG. 2B is a circuit diagram illustrating an alternative output unit according to one or more other embodiments.

FIG. 2B is a circuit diagram illustrating the exemplary output unit 160 of FIG. 1, according to another embodiment of the present invention. In FIG. 2B, the same reference numbers as in FIG. 2A will be used to refer to the same or like parts, and thus a detailed description thereof will be described briefly or omitted herein for convenience of description. Compared to the output switches 165-1 to 165-*m* of FIG. 2A, the output switches 167-1 to 167-*m* of FIG. 2B are in different locations than the output switches 165-1 to 165-*m* of FIG. 2A.

Referring to FIG. 2B, each of the output switches 167-1 to 167-*m* (where m is a natural number greater than 1) may be between a corresponding output terminal of the DAC unit 150 configured to output the analog signals DA1 to DAm and an input terminal of a corresponding amplifier 161-1 to 161-*m*.

For example, the output switches 167-1 to 167-*m* (where m is a natural number greater than 1) may be between the output terminals of a corresponding digital-to-analog converter (DAC) of the DAC unit 150 and an input terminal of a corresponding amplifier 161-1 to 161-*m*.

In accordance with embodiments including the multiplexer unit, the output switches may also be between an output terminal of the multiplexer unit and an input terminal of a corresponding amplifier 161-1 to 161-*m*.

The output controller 170 may generate switch control signals CSW1 to CSWm configured to control the output switches 165-1 to 165-*m* or 167-1 to 167-*m* in response to the plurality of clock signals CS<1:*n*> and/or the internal clock signal PCLK.

The source driver 100 of FIG. 1 may include a plurality of drivers configured to drive a plurality of channels and/or a plurality of output pads P1 to Pm. The plurality of drivers may be classified according to a plurality of groups.

For example, the switch control signals applied to the output switches in each of the groups may have different delay times based on or in response to the (or a corresponding) source output enable signal SOE.

For example, although a difference in the delay time between two contiguous switch control signals supplied to one of the groups may be identical to a difference in the delay time between two contiguous switch control signals supplied to another one of the groups, the scope or spirit of the present disclosure is not limited thereto.

In accordance with one or more other embodiments of the present invention, the difference in the delay time between two contiguous switch control signals supplied to one of the groups may be different from the difference in the delay time between two contiguous switch control signals to the other one of the groups. For example, the difference in the delay time between one of the switch control signals supplied to each group and a contiguous switch control signal thereto may also be different from the difference in the delay time between another one of the switch control signals to each group and a contiguous switch control signal thereto.

The difference in the delay time between two contiguous switch control signals supplied to at least one of the groups may be different from the difference in the delay time between two contiguous switch control signals supplied to another one of the remaining groups.

For example, the difference in the delay time between two contiguous switch control signals supplied to one of the groups may be different from the difference in the delay time between two contiguous switch control signals supplied to the other one of the groups.

Figure 3:
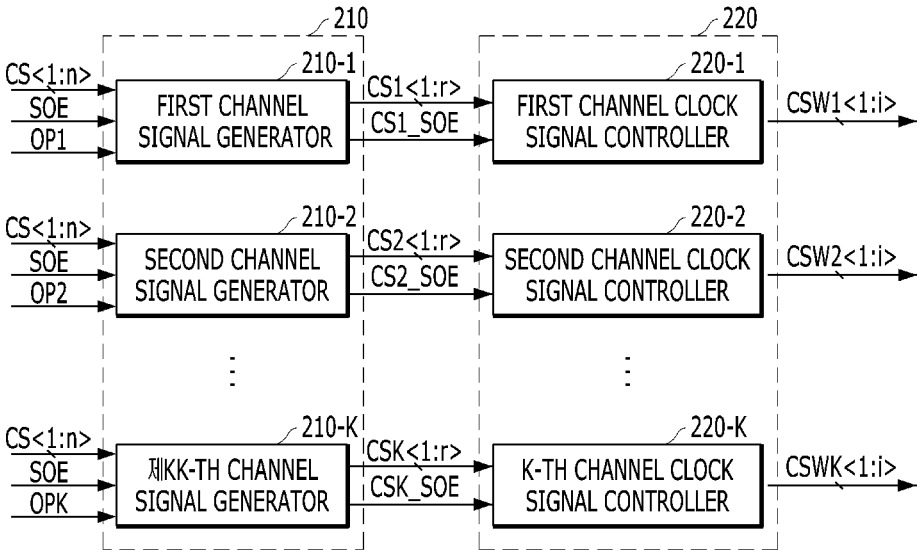
FIG. 3 is a block diagram illustrating an exemplary output controller suitable for the source driver of FIG. 1 according to one or more embodiments of the present invention.

FIG. 3 is a block diagram illustrating an exemplary output controller suitable for the output controller 170 of FIG. 1, according to one or more embodiments of the present invention.

Referring to FIG. 3, the output controller may include a channel signal generator unit 210 including a plurality of channel signal generators 210-1 to 210-K (where K is a natural number greater than 1) corresponding to a plurality of groups, and a channel clock signal controller 220 including a plurality of channel clock signal controllers 220-1 to 220-K (where K is a natural number greater than 1) corresponding to the plurality of channel signal generators.

For example, the plurality of channel signal generators 210-1 to 210-K may include first to K-th channel signal generators.

The channel signal generator unit 210 may (i) receive a plurality of clock signals CS<1:*n*> (where n is a natural number greater than 1) from the clock recovery unit 110, (ii) receive the source output enable signal SOE and selection signals OP1 to OPK (where K is a natural number greater than "1") from the logic controller 120, (iii) divide and/or delay the plurality of clock signals CS<1:*n*> (where n is a natural number greater than 1) based on or in response to the selection signals OP1 to OPK (where K is a natural number greater than 1), (iv) generate channel clock signals CS1<1:r> to CSK<1:r> (where r is a natural number greater than 1) (e.g., according to the division and/or delay), and (v) generate channel signals CS1_SOE to CSK_SOE (e.g., according to a delay of the source output enable signal SOE), based on or in response to the selection signals.

For example, each of the channel signal generators 210-1 to 210-K (where K is a natural number greater than 1) may receive the plurality of clock signals CS<1:*n*> (where n is a natural number greater than 1) and a corresponding one of the selection signals OP1 to OPK (where K is a natural number greater than 1).

Each of the channel signal generators 210-1 to 210-K (where K is a natural number greater than 1) may divide and/or delay the plurality of clock signals CS<1:*n*> based on or in response to a corresponding selection signal OP1 to OPK (where K is a natural number greater than 1), and may output the channel clock signals CS1<1:r> to CSK<1:r> (where K is a natural number greater than 1 and r is equal to or less than n) based on or in response to the division and/or delay.

Each of the channel signal generators 210-1 to 210-K (where K is a natural number greater than 1) may delay the source output enable signal SOE based on or in response to a corresponding selection signal OP1 to OPK (where K is a natural number greater than 1), and may generate one of the channel signals CS1_SOE to CSK_SOE (where K is a natural number greater than 1) based on or in response to the delay.

Figure 4:
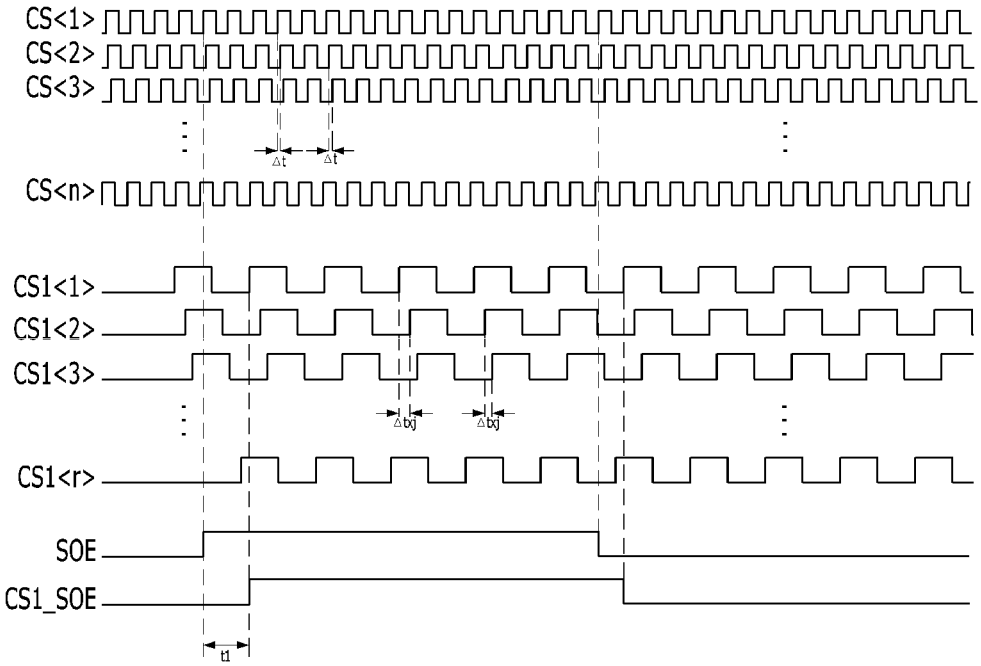
FIG. 4 is a timing diagram illustrating channel clock signals and a first channel signal that are output from the first channel signal generator shown in FIG. 3.

FIG. 4 is a timing diagram illustrating the generation of the channel clock signals CS1<1:r> and a first channel signal CS1_SOE that are output from the first channel signal generator 210-1 shown in FIG. 3. For example, FIG. 4 is a timing diagram illustrating the generation of the channel clock signals CS1<1:r> and the first channel signal CS1_SOE that correspond to a first group among the plurality of groups.

Referring to FIG. 4, each of the channel clock signals CS1<1:r> may be obtained by dividing and delaying a corresponding clock signal CS<1:*n*> based on or in response to a corresponding selection signal OP1 to OPK.

Although each of the channel clock signals CS1<1:r> shown in FIG. 4 may be obtained when a corresponding clock signal CS<1:*n*> is divided by 2, thereby doubling the signal period, the scope or spirit of the present disclosure is not limited thereto. In accordance with one or more other embodiments of the present invention, each of the channel clock signals CS1<1:r> may be obtained when a corresponding clock signal CS<1:*n*> is divided by R (where R is a positive(+) real number). For example, R is a positive(+) number greater than 1.

Contiguous channel clock signals CS1<1:r> may have a time difference therebetween corresponding to a reference delay time denoted by (Δt×j) (where j is a real number greater than 1), based on or in response to the corresponding selection signal OP1 to OPK. Here, j may be determined by the corresponding selection signal OP1 to OPK.

For example, a reference delay time (Δt) may be the difference in the delay time between contiguous clock signals (e.g., CS<Q> and CS<Q+1>, where Q is a natural number greater than 1 and optionally less than or equal to n).

The first channel signal CS1_SOE may be obtained by delaying the source output enable signal SOE by a first delay time (t1). The first delay time (t1) may be determined by the first selection signal OP1.

The channel signals CS1_SOE to CSK_SOE generated by the plurality of channel signal generators 210-1 to 210-K (where K is a natural number greater than 1) corresponding to the plurality of groups may have different delay times based on or in response to the source output enable signal SOE.

For example, although the same delay time may occur between two contiguous channel signals generated from two contiguous channel signal generators 210-1 to 210-K of FIG. 3 (where K is a natural number greater than 1), the scope or spirit of the present disclosure is not limited thereto.

For example, different delay times may be present between two contiguous channel signals of at least one of the channel signals CS1_SOE to CSK_SOE.

Each of the channel clock signal controllers 220-1 to 220-K in FIG. 3 may receive channel clock signals CS1<1:m> to CSK<1:m> and channel signals CS1_SOE to CSK_SOE from a corresponding channel signal generator 210-1 to 210-K.

Each of the channel clock signal controllers 220-1 to 220-K in FIG. 3 may generate switch control signals for controlling output switches in one of the groups upon receiving channel clock signals and a channel signal from the corresponding channel signal generator.

The respective channel clock signal controllers 220-1 to 220-K may allow the received channel signal to be synchronized or clocked by the received channel clock signals, thereby generating a plurality of switch control signals CSW1<1:i> to CSWK<1:i>.

Figure 5:
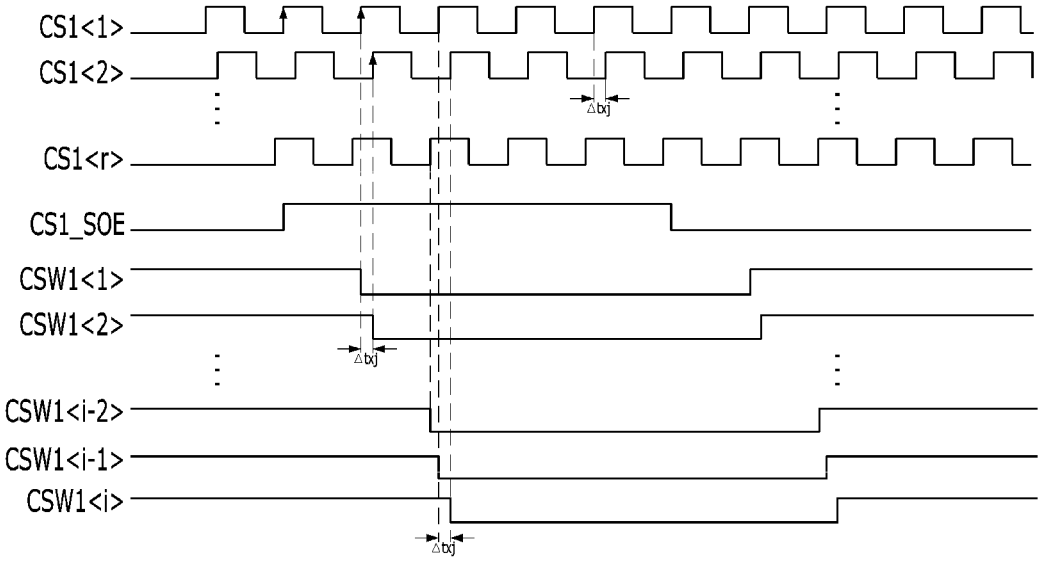
FIG. 5 is a timing diagram illustrating switch control signals output from the first channel clock signal controller shown in FIG. 3.

FIG. 5 is a timing diagrams illustrating the generation of switch control signals CSW1<1:i> from the first channel clock signal controller 220-1 shown in FIG. 3.

Referring to FIG. 5, each of the switch control signals CSW1<1:i> to CSWK<1:i> may be generated by synchronizing or clocking the first channel signal CS1_SOE to a corresponding channel clock signal CS1<1:m> to CSK<1:m>.

A time difference corresponding to a reference delay time denoted by (Δt×j) (where j is a real number greater than 1) may be present between two contiguous switch control signals CSW1<1:i> to CSWK<1:i>.

For example, switch control signals CSW1<1:i> to CSWK<1:i> supplied to output switches of drivers in each of the groups may have different delay times based on or in response to the source output enable signal SOE.

For example, the difference in the delay time between two contiguous switch control signals to at least one of the groups may be different from the difference in the delay time between two contiguous switch control signals to another one of the remaining groups.

For example, although the difference in the delay time between two contiguous switch control signals to one of the groups may be identical to the difference in the delay time between two contiguous switch control signals to the other one of the groups, the scope or spirit of the present disclosure is not limited thereto. In accordance with one or more other embodiments of the present invention, the difference in the delay time between the two contiguous switch control signals to one of the groups may be different from the difference in the delay time between two contiguous switch control signals to the other one of the groups.

The difference in the delay time between two contiguous channel clock signals generated by the channel signal generator in one of the groups may be different from the difference in the delay time between the two contiguous clock signals generated by the channel signal generator in the other one of the groups.

Each channel clock signal controller (e.g., 220-1 in FIG. 3) may include shift registers corresponding to the channel clock signals (e.g., CS1<1:r>).

Each of the shift registers in one of the channel clock signal controllers may (i) receive a channel signal (e.g., CS1_SOE), (ii) be synchronized with a corresponding channel clock signal (e.g., CS1<1:r>), and (iii) generate switch control signals (e.g., CSW1<1:i>) for controlling the output switches in a corresponding group.

Figure 6:
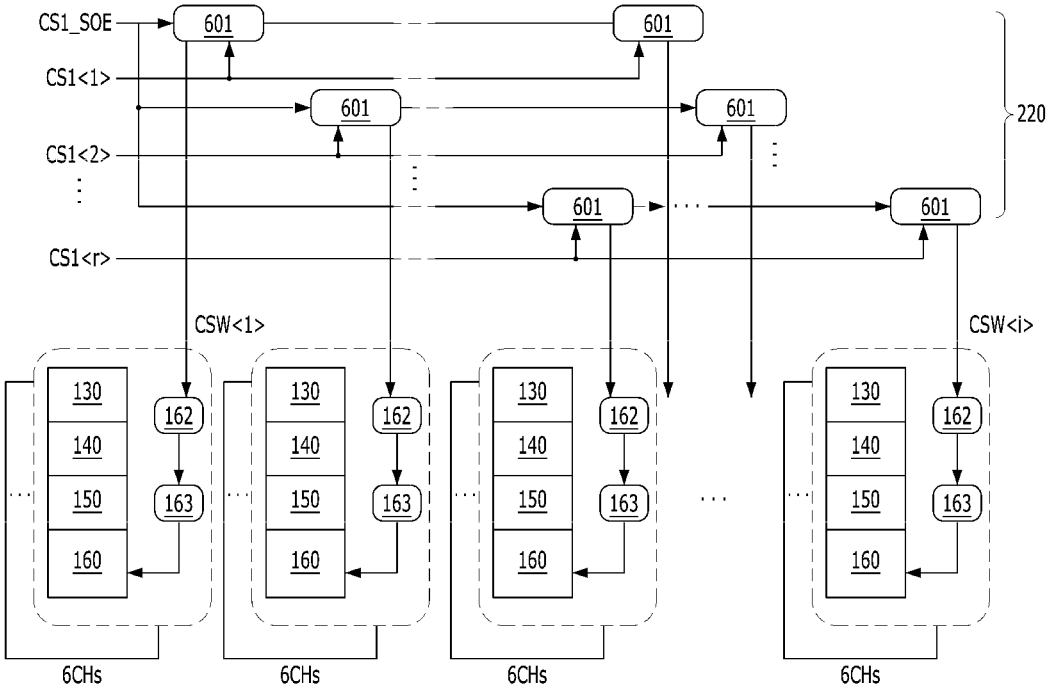
FIG. 6 is a block diagram illustrating an exemplary first channel clock signal controller suitable for the output controller shown in FIG. 3.

FIG. 6 is a block diagram illustrating an exemplary channel clock signal controller suitable for the first channel clock signal controller 220-1 shown in FIG. 3.

The detailed description of the channel clock signal controller shown in FIG. 6 may also be equally or similarly applied to the remaining channel clock signal controllers (e.g., 220-2 to 220-K).

Referring to FIG. 6, the channel clock signal generator may include at least one shift register 601 corresponding to each of the channel clock signals CS1<1> to CS1<r>.

For example, the channel clock signal controller may include at least two shift registers 601 corresponding to each respective channel clock signal CS1<1> to CS1<r>.

For example, although the shift register 601 may be implemented as at least one flip-flop, the scope or spirit of the present disclosure is not limited thereto.

At least one shift register 601 corresponding to each of the channel clock signals CS1<1> to CS1<r> may receive a first channel signal CS1_SOE.

The at least one shift register 601 may allow the first channel signal CS1_SOE to be synchronized with channel clock signals CS1<1:m>, thereby generating switch control signals CSW<1> to CSW<i>.

The shift register(s) 601 may generate switch control signals corresponding to the plurality of channels (e.g., 6 channels).

For example, a first channel clock signal controller 220-1 that includes at least two shift registers 601 corresponding to each of the channel clock signals CS1<1> to CS1<r> will hereinafter be described in detail.

An output signal of the last stage of the first shift register 601 may be supplied as an input signal of an initial stage of the second shift register 601 for each of the channel clock signals CS1<1> to CS1<r>.

For example, each of the first and second shift registers 601 may be synchronized or clocked by the same clock signal CS1<1>, the first shift register 601 may supply a carrier signal to the second shift register 601, and the second shift register 601 may generate a switch control signal CSW<1> to CSW<i> that have a 1-cycle time difference with respect to other switch control signals generated from the first shift register 601.

Since the same reference delay time denoted by (Δt×j) (where j is a real number greater than 1) is present between two contiguous clock signals CS1<1> to CS1<r>, the same reference delay time denoted by (Δt×j) (where j is a real number greater than "1") may also be present between two switch control signals corresponding to two contiguous channels.

Figure 7:
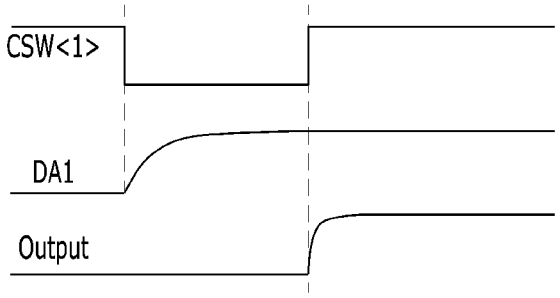
FIG. 7 is a timing diagram illustrating an exemplary first switch control signal configured to control the output switches shown in FIG. 2A, an exemplary input signal of a first amplifier, and an exemplary output signal of the source driver.

FIG. 7 is a timing diagram illustrating (i) the exemplary first switch control signal CSW1 configured to control the output switch 165-1 shown in FIG. 2A or the output switch 167-1 shown in FIG. 2B, (ii) an input signal DA1 to the first amplifier 161-1, and (iii) an output signal OUTPUT from the source driver.

Referring to FIG. 7, when the first switch control signal CSW<1> is at a first level (e.g., a low level), the input signal DA1 is amplified or buffered by an amplifier. When the first switch control signal CSW<1> is at a second level (e.g., a high level), the output signal Output from the source driver may be output through the pad. As a result, output time points of the channels of the source driver may be controlled by the switch control signal CSW<1>.

Figure 8:
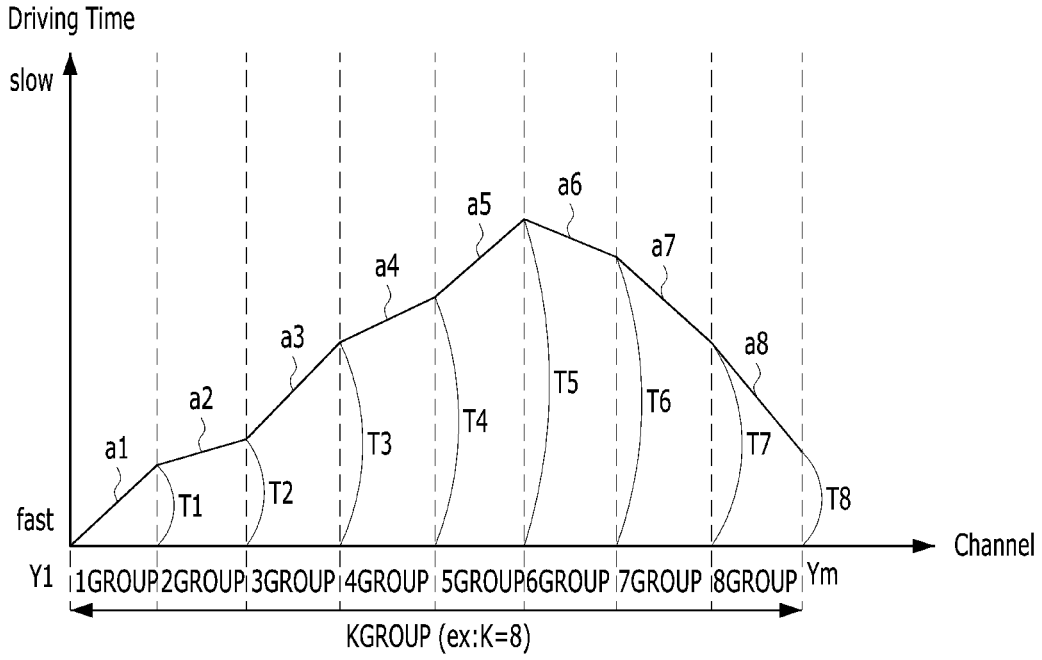
FIG. 8 is a graph illustrating driving times of individual groups of an exemplary source driver according to one or more embodiments of the invention.

FIG. 8 is a graph illustrating drive times of individual groups of the source driver 100. In FIG. 8, the X-axis may denote groups of the source driver 100, and the Y-axis may denote drive times of the groups.

Referring to FIG. 8, channels of the source driver 100 may be classified according to a plurality of groups (K groups, where K is a natural number greater than 1). For example, each of the plurality of groups (e.g., first to eighth groups) may have different channels.

A time difference in the drive time point between two contiguous channels in each group may be identical to the time difference in the drive time point between two other contiguous channels in each group.

Although the respective groups may have the same number of channels, the scope or spirit of the present disclosure is not limited thereto. One or more drive times (e.g., T1 to T8) of the different groups may be different from each other.

The time difference in the drive time point between two contiguous channels in one group may be different from the time difference in the drive time point between two contiguous channels in another group.

For example, the time difference in the drive time point between two contiguous channels in one of groups may be different from the time difference in the drive time point between two contiguous channels in the other one of the groups.

In addition, drive speeds a1 to a8 for driving channels of the different groups may be different from each other.

Various shapes of drive time points may appear by controlling directivity of the source driver. For example, although the first to fifth groups of FIG. 8 may be sequentially driven in a direction from left to right of either data lines of the panel or channels of the source driver, and the sixth to eighth groups of FIG. 8 may be sequentially driven in a direction from right to left of either the data lines of the panel or the channels of the source driver, the scope or spirit of the present disclosure is not limited thereto. In addition, the driving directivity may be reversed.

Various embodiments of the present invention may allow channel groups based on a predetermined unit to have different time differences in the source driver for driving a display panel, such that the source driver can solve image problems caused by a deviation among channels in the display panel.

Gate signals for turning on or off pixels of larger-sized display panels may have a relatively large difference therebetween, according to the pixel position in the display panels. Various embodiments of the present invention may adjust drive time points of individual channel groups, such that one or more embodiments may compensate for a deviation in gate signals, according to the pixel position in the display panel, resulting in formation of a stabilized image.

FIG. 9 illustrates an exemplary display device 200, according to one or more embodiments of the present invention.

Referring to FIG. 9, the display device 200 may include a display panel 201, a timing controller 205, a data driver unit 210, and a gate driver unit 1220.

The display panel 201 may include gate lines 1221 and/or 204 in rows and data lines 1231 in columns. The gate lines 1221 and/or 204 may cross the data lines 1231, such that the gate lines 1221 and/or 204 and the data lines 1231 perpendicular to the gate lines 1221 and/or 204 form a matrix. The display panel 201 may further include pixels (e.g., P1) respectively connected to intersections of the gate lines and the data lines.

The pixels may be connected to the gate lines 1221 and/or 204 and the data lines 1231, and may be in a matrix having rows and columns.

Each pixel (e.g., P1) may include a transistor (Ta) connected to a corresponding gate line 1221 and/or 204 and a corresponding data line 1231, and a capacitor (Ca) connected to the transistor (Ta).

For example, the pixels may include Red (R) sub-pixels, Green (G) sub-pixels, and Blue (B) sub-pixels. Each of the R sub-pixels, the G sub-pixels, and the B sub-pixels may include (i) a transistor (Ta) connected to a gate line and a data line and (ii) a capacitor (Ca) connected to the transistor (Ta).

The timing controller 205 may output a clock signal CLK, data DATA, a control signal CONT configured to control the source driver unit 210, and a control signal G CONT configured to control the gate driver 1220.

Although the clock signal CLK, the data DATA, and the control signal CONT in FIG. 9 can be time-divisionally transmitted to the respective data drivers 210-1 to 210-P through a single transmission line, the scope or spirit of the present disclosure is not limited thereto.

In accordance with one or more other embodiments of the present invention, the clock signal CLK, the data DATA, and the control signal CONT may also be transmitted to the respective data drivers 210-1 to 210-P through different transmission lines.

The gate driver unit 1220 may drive the gate lines 1221, include a plurality of gate drivers, and output gate drive signals configured to control the transistors (Ta) of the respective pixels connected to the gate line 1221.

The data driver unit 210 may drive data lines or channels 1231 of the display panel, and may include a plurality of data drivers 210-1 to 210-P (where P is a natural number greater than 1). Each of the data drivers 210-1 to 210-P (where P is a natural number greater than 1) may be a source driver 100 as shown in FIG. 1.

As is apparent from the above description, the various embodiments can allow a plurality of channel groups based on a predetermined unit to be driven and/or to have different time differences in a source driver for driving a display panel, such that the source driver can solve image problems caused by a deviation among the channels in the display panel.

In addition, the source driver according to embodiments of the invention can compensate for a deviation in gate signals according to the location or position of a pixel in a display panel by adjusting the drive starting times of individual channel groups, such that display images can be stabilized.

Various embodiments of the present invention, as described above, may include particular features, structures, or characteristics, but not every embodiment necessarily includes the particular features, structures, or characteristics. Furthermore, the particular features, structures or characteristics in various embodiments may be combined in any suitable manner, as would be apparent to one of ordinary skill in the art from this disclosure, in one or more embodiments of the present invention. Therefore, combinations of features of different embodiments are meant to be within the scope of the invention.

What is claimed is:

1. A source driver comprising:

a latch unit configured to store data;

a digital-to-analog conversion (DAC) unit configured to convert the data from the latch unit into analog signals;

a plurality of amplifiers configured to (i) amplify or buffer the analog signals and (ii) output the amplified or buffered analog signals;

a plurality of output pads;

a plurality of output switches between the digital-to-analog conversion (DAC) unit and the plurality of output pads, corresponding to the plurality of amplifiers;

an output controller configured to generate a plurality of switch control signals configured to control the plurality of output switches based on or in response to a source output enable signal, a clock recovery unit configured to (i) receive an input signal including a clock signal and data, (ii) recover the clock signal from the received input signal, (iii) generate a plurality of delayed clock signals having different delay times from or in response to the recovered clock signal, and (iv) generate an internal clock signal from or in response to at least one of the plurality of clock signals; and a logic controller configured to recover image-associated data from the input signal using the internal clock signal, and supply the recovered image-associated data to the latch unit, wherein the plurality of amplifiers and the plurality of output switches comprise a plurality of groups, the switch control signals in each of the groups have different delay times, and a difference in a delay time between two contiguous switch control signals to at least one of the groups is different from a difference in a delay time between two contiguous switch control signals to each of the other groups.

2. The source driver according to claim 1, wherein the difference in the delay time between the two contiguous switch control signals to the at least one of the groups is identical to the difference in the delay time between the two contiguous switch control signals to the other groups.

3. The source driver according to claim 1, wherein each of the output switches is between an input terminal of a corresponding amplifier and a corresponding output terminal of the digital-to-analog conversion (DAC) unit.

4. The source driver according to claim 1, wherein each of the output switches is between an output terminal of a corresponding amplifier and a corresponding output pad.

5. The source driver according to claim 1, wherein the source output enable signal controls output signals from the amplifiers.

6. The source driver according to claim 1, wherein the logic controller generates the source output enable signal using the input signal and the internal clock signal.

7. The source driver according to claim 6, wherein the output controller comprises:

a channel signal generator unit configured to (i) receive the plurality of delayed clock signals from the clock recovery unit, (ii) receive the source output enable signal and a selection signal from the logic controller, (iii) generate channel clock signals by dividing and/or delaying the plurality of delayed clock signals based on or in response to the selection signal, and/or (iv) generate a channel signal by delaying the source output enable signal; and a channel clock signal controller configured to receive the plurality of channel clock signals and the channel signal from the channel signal generator unit, and generate the switch control signals using the received channel clock signals and the received channel signal.

8. A display device comprising:

a display panel including gate lines, data lines, and pixels connected to the gate and data lines, the pixels being in a matrix having rows and columns;

a data driver configured to drive the data lines; and a gate driver configured to drive the gate lines, wherein each of the data drivers is the source driver of claim 1.

9. A source driver comprising:

a plurality of output pads;

a plurality of drivers configured to supply drive signals to the plurality of output pads;

an output controller configured to generate switch control signals based on or in response to a source output enable signal, a clock recovery unit configured to (i) receive an input signal including a clock signal and data, (ii) recover the clock signal from the received input signal, (iii) generate a plurality of delayed clock signals having different delay times from or in response to the recovered clock signal, and (iv) generate an internal clock signal from or in response to at least one of the plurality of clock signals; and a logic controller configured to recover image-associated data from the input signal using the internal clock signal, and supply the recovered image-associated data to the latch unit, wherein each of the plurality of drivers includes:

a latch unit configured to store data;

a digital-to-analog conversion (DAC) unit configured to convert the data from the latch unit into analog signals;

an output unit comprising a plurality of amplifiers configured to amplify or buffer the analog signals and output the amplified or buffered signals; and an output switch between the digital-to-analog conversion (DAC) unit and a corresponding output pad, and controlled by a corresponding switch control signal, wherein the plurality of drivers comprise a plurality of groups, and each of the plurality of groups include at least two drivers, switch control signals to output switches of the drivers in each of the groups have different delay times based on or in response to the source output enable signal, and a difference in a delay time between two contiguous switch control signals to at least one of the groups is different from a difference in a delay time between two contiguous switch control signals to each of the other groups, and the source output enable signal controls output signals of the amplifiers.

10. The source driver according to claim 9, wherein the difference in the delay time between the two contiguous switch control signals to one of the groups is identical to the difference in the delay time between the two contiguous switch control signals supplied to the other groups.

11. The source driver according to claim 9, wherein each of the output switches in each of the groups is between an input terminal of a corresponding amplifier in each of the groups and a corresponding output terminal of the digital-to-analog conversion (DAC) unit.

12. The source driver according to claim 9, wherein each of the output switches in each of the groups is between an output terminal of a corresponding one amplifier in each of the groups and a corresponding output pad.

13. The source driver according to claim 9, wherein the logic controller generates the source output enable signal using the input signal and the internal clock signal.

14. The source driver according to claim 13, wherein the output controller comprises:

a plurality of channel signal generators corresponding to the plurality of groups; and a plurality of channel clock signal controllers corresponding to the plurality of channel signal generators, wherein each of the channel signal generators is configured to:

receive the plurality of delayed clock signals from the clock recovery unit, and receive the source output enable signal and a corresponding selection signal from the logic controller;

generate channel clock signals by dividing and/or delaying the plurality of clock signals based on or in response to a corresponding selection signal; and generate a channel signal by delaying the source output enable signal based on or in response to a corresponding selection signal, and each of the channel clock signal controllers is configured to generate switch control signals configured to control output switches in a corresponding group using the channel clock signals and the channel signal from a corresponding channel signal generator.

15. The source driver according to claim 14, wherein a difference in a delay time between two contiguous channel clock signals among the channel clock signals from the channel signal generator in each of the groups is identical to a difference in a delay time between two other channel clock signals among the channel clock signals.

16. The source driver according to claim 14, wherein the channel signals have different delay times based on or in response to the source output enable signal.

17. The source driver according to claim 14, wherein a difference in a delay time between two contiguous channel clock signals from the channel signal generator in one of the groups is different from a difference in a delay time between two contiguous clock signals from the channel signal generator in another one of the groups.

18. The source driver according to claim 14, wherein:

each of the channel clock signal controllers includes at least one shift register corresponding to one of the channel clock signal, and each of the shift registers receives the channel signal and generates a switch control signal configured to control output switches in a corresponding group by synchronizing with a corresponding channel clock signal.

* * * * *